United States Patent [19]

Keip

[11] Patent Number: 4,979,358

[45] Date of Patent: Dec. 25, 1990

[54] ROTARY FILM WRAPPING APPARATUS

[76] Inventor: Charles P. Keip, 5820 Canal Ave., Grandville, Mich. 49418

[21] Appl. No.: 359,251

[22] Filed: May 31, 1989

[51] Int. Cl.[5] ..... B65B 13/04

[52] U.S. Cl. ..... 53/556; 53/588; 198/817

[58] Field of Search ..... 53/556, 587, 588, 210, 53/441; 198/817

[56] References Cited

U.S. PATENT DOCUMENTS

| | | | |
|---|---|---|---|
| 603,585 | 5/1898 | Crowell . | |
| 2,651,900 | 9/1953 | Heilman . | |
| 2,962,152 | 11/1960 | Lathrop | 198/817 |
| 3,003,297 | 10/1961 | Broadhead et al. . | |
| 3,289,818 | 12/1966 | Kittredge | 198/817 |
| 3,726,389 | 4/1973 | Klein et al. . | |
| 3,738,478 | 6/1973 | Tourtellotte . | |
| 3,788,199 | 1/1974 | Sato et al. . | |
| 3,793,798 | 2/1974 | Lancaster, III et al. . | |
| 3,867,806 | 2/1975 | Lancaster, III et al. . | |
| 4,050,220 | 9/1977 | Lancaster et al. . | |
| 4,050,221 | 9/1977 | Lancaster, III et al. . | |
| 4,077,179 | 3/1978 | Lancaster et al. . | |
| 4,079,565 | 3/1978 | Lancaster, III et al. . | |
| 4,110,957 | 9/1978 | Lancaster et al. . | |
| 4,177,959 | 12/1979 | Lancaster et al. . | |
| 4,178,734 | 12/1979 | Lancaster et al. . | |
| 4,204,377 | 5/1980 | Lancaster et al. . | |
| 4,232,501 | 11/1980 | Stackhouse . | |
| 4,235,062 | 11/1980 | Lancaster, III et al. . | |
| 4,255,918 | 3/1981 | Lancaster et al. . | |
| 4,271,657 | 6/1981 | Lancaster, III et al. . | |
| 4,300,326 | 11/1981 | Stackhouse . | |
| 4,302,920 | 12/1981 | Lancaster et al. . | |
| 4,317,322 | 3/1982 | Lancaster et al. . | |
| 4,336,679 | 6/1982 | Lancaster et al. . | |
| 4,387,548 | 6/1983 | Lancaster et al. . | |
| 4,387,552 | 6/1983 | Lancaster et al. . | |
| 4,413,463 | 11/1983 | Lancaster . | |
| 4,418,510 | 12/1983 | Lancaster, III et al. . | |
| 4,429,514 | 2/1984 | Lancaster et al. . | |
| 4,503,658 | 3/1985 | Mouser et al. . | |
| 4,514,955 | 5/1985 | Mouser et al. . | |
| 4,524,568 | 6/1985 | Lancaster et al. . | |
| 4,549,388 | 10/1985 | Lancaster . | |
| 4,553,374 | 11/1985 | Lancaster et al. . | |
| 4,593,518 | 6/1986 | Lancaster . | |
| 4,628,671 | 12/1986 | Storm et al. . | |
| 4,676,048 | 6/1987 | Lancaster et al. . | |
| 4,691,497 | 9/1987 | Lancaster . | |
| 4,712,354 | 12/1987 | Lancaster et al. . | |
| 4,712,686 | 12/1987 | Lancaster et al. . | |
| 4,722,170 | 2/1988 | Ball et al. . | |
| 4,735,033 | 4/1988 | Stackhouse . | |
| 4,738,079 | 4/1988 | Lancaster et al. . | |
| 4,747,254 | 5/1988 | Lancaster . | |
| 4,754,594 | 7/1988 | Lancaster . | |
| 4,756,143 | 7/1988 | Lancaster . | |
| 4,761,934 | 8/1988 | Lancaster . | |
| 4,765,120 | 8/1988 | Phillips . | |
| 4,779,396 | 10/1988 | Stackhouse . | |
| 4,866,909 | 9/1989 | Lancaster | 53/556 X |

*Primary Examiner*—John Sipos

*Attorney, Agent, or Firm*—Warner, Norcross & Judd

[57] ABSTRACT

A rotary stretch wrapping apparatus for wrapping a product in a plastic film includes a base frame, a rotary support structure, a roll of film mounted to the support structure, a film dispensing mechanism, a prestretching device, and a conveyor system for passing the product through the support structure. The conveyor system includes a pair of horizontally adjacent endless conveyors having lugs adapted to prevent the lugs traveling the return path from hindering the product or the plastic wrap.

28 Claims, 11 Drawing Sheets

ROTARY FILM WRAPPING APPARATUS

BACKGROUND OF THE INVENTION

The present invention pertains to a wrapping apparatus, and in particular to a rotary stretch wrapping apparatus for quickly and efficiently providing a continuous wrap about a product.

The packaging of products to be shipped in a wrap of stretched plastic film is becoming increasingly popular. Stretch wrapping offers several advantages over the use of boxes, kraft paper, and other conventional packaging means. In particular stretch wrapping provides a durable, water resistant, and inexpensive covering for the product. Moreover, a product may be wrapped with great speed to thereby increase the resultant throughput.

One known stretch wrapping apparatus is disclosed in U.S. Pat. No. 4,317,322 to Lancaster et al., and entitled ROTATABLE FILM WRAPPING APPARATUS WITH WRAP CARRYING MECHANISM. Although such a machine will provide a continuous wrap of plastic film about a product, the machine is comprised of complex, inefficient, and unbalanced components. More specifically, the Lancaster patent '322 discloses a complex conveyor system for passing the product through the wrapping machine and an off-balance rotary structure adapted to circumscribe the product.

In a rotary stretch wrapping machine, the plastic film is tightly wrapped about the product and the conveyor upon which it rests. An ordinary conveyor is therefore useless since engagement of the film with the return path fights against the forward moving product. To overcome this problem, Lancaster has developed a complex conveyor system comprised of superimposed belts and an array of pulleys. However, fabrication of such a system involves high manufacturing and maintenance costs.

In a rotary stretch wrapping operation, the wrapping mechanism is spun about the product by a rotary support structure. In Lancaster '322, the rolls of film are mounted in a cantilevered manner to a circular rotary structure which is rotatably driven to effect wrapping of the product. These rolls, however, are frequently quite heavy and therefore engender large moment forces in the rotary structure as it is rotated about the product. These forces create a substantial imbalance in the structure which not only will hasten bearing wear, but also may pose a safety hazard.

In wrapping products with a rotary machine, problems may arise with respect to irregularities in the shape of the products to be wrapped. For instance, if a relatively flat product having a large width dimension is to be wrapped, a great deal more film will be needed to cover the width than will be needed to cover the height thereof. Yet, in many power driven machines, the film is dispensed at a constant rate irrespective of any irregularities. Hence, these machines, if operated on any but the most uniform products, will generate large amounts of slack in the film and thus foul the operation. An example of such an apparatus is disclosed in U.S. Pat. No. 4,418,510 to Lancaster, III et al., and entitled STRETCH WRAPPING APPARATUS AND PROCESS.

Additionally, wrapping machines are often used to either: (1) independently wrap products, wherein the film is sheared after each individual product is wrapped; or (2) wrapped in a somewhat sporadic manner wherein only one or a few products are wrapped in series at any one time. In these situations, the operator must manually feed the leading end of the film into a clamp or beneath the product with each product to be individually wrapped or with each leading product in a series of products to be wrapped. This feeding step is a slow and cumbersome task which requires a significant amount of down time for the apparatus.

SUMMARY OF THE INVENTION

In a first aspect, the present invention includes a novel, efficient conveyor system for transporting the product through a rotary wrapping machine. The system includes a pair of endless conveyors carried by vertical axles and positioned horizontally to one another to cooperatingly transport products to be wrapped. More specifically, the conveyors are oriented such that the return paths are positioned between the two outer, forward carrying paths. The conveyors further include supports which are expanded outwardly by cams when traversing the forward, carrying paths and contracted when traversing the return paths. In this way, the expanded outer supports hold the products above the supports of the return paths as they are conveyed through the wrapping machine. Furthermore, the expanded conveying supports also engage and hold the wrapped film away from the contracted return path supports so that the film can be moved unimpeded with the product being wrapped. This construction is much less complicated and more efficient than the conveyors of the prior art. Consequently, an increased durability and reduced maintenance is experienced.

In a second aspect of the invention, the apparatus further includes a preliminary assembly which acts to measure the dimensions of the product and center the product on the conveyor prior to the wrapping procedure. With the measurement of the product accomplished, the dispensing rate for the film may be adjusted to accommodate irregularities in the product's dimensions. This preliminary assembly, then, facilities the use of the present invention for wrapping a wide variety of differently shaped and sized products.

In a third aspect of the invention, the apparatus further includes a reciprocal clamping component which is adapted to clamp and hold a trailing end of the film subsequent to wrapping an individual product before the film is sheared away from the roll. In this way, the need for the operator to feed the film into a clamp or under the product before wrapping of the next product can begin is eliminated.

In a fourth aspect of the invention, the apparatus further includes a rotary film mounting framework comprised of a pair of substantially parallel circular subframes and a plurality of interconnecting braces. Such a framework is more effectively able to offset the weight of the mounted roll of film and wrapping equipment, and thereby provide a stable wrapping apparatus. This benefit, in turn will increase the life span of the machine by decreasing the stresses in the various components. Moreover, the present invention offers a more safely operated machine, due to the elimination, of much of the imbalance.

In a fifth aspect of the invention, the apparatus further includes an air biasing system for maintaining the engagement of the film dispensing roller at a substantially constant pressure against the roll of film, irrespective of the diameter of the roll of film. This biasing arrangement ensures that no significant slippage occurs between the roll of film and the driving roller to disrupt the dispensation of the film. The air biasing system includes an air cylinder coupled to the driving roller to bias the roller against the outer periphery of the roll of film, and an air supply system which supplies pressurized air to the cylinder from a central base not mounted on the rotary subframes. This supply system includes a plurality of holes spaced about the periphery of one of the circular subframes and a cooperating pressure source in sliding engagement therewith. As the subframe is rotated, the holes are passed beneath the pressure source and injected with a shot of pressurized air which is subsequently routed through a containment reservoir in the subframe and ultimately to the biasing cylinder.

These and other objects, advantages, and features of the present invention will be more fully understood and appreciated by reference to the written specification and appended drawings.

DETAILED DESCRIPTION OF THE PREFERRED EMBODIMENT

Figure 1:
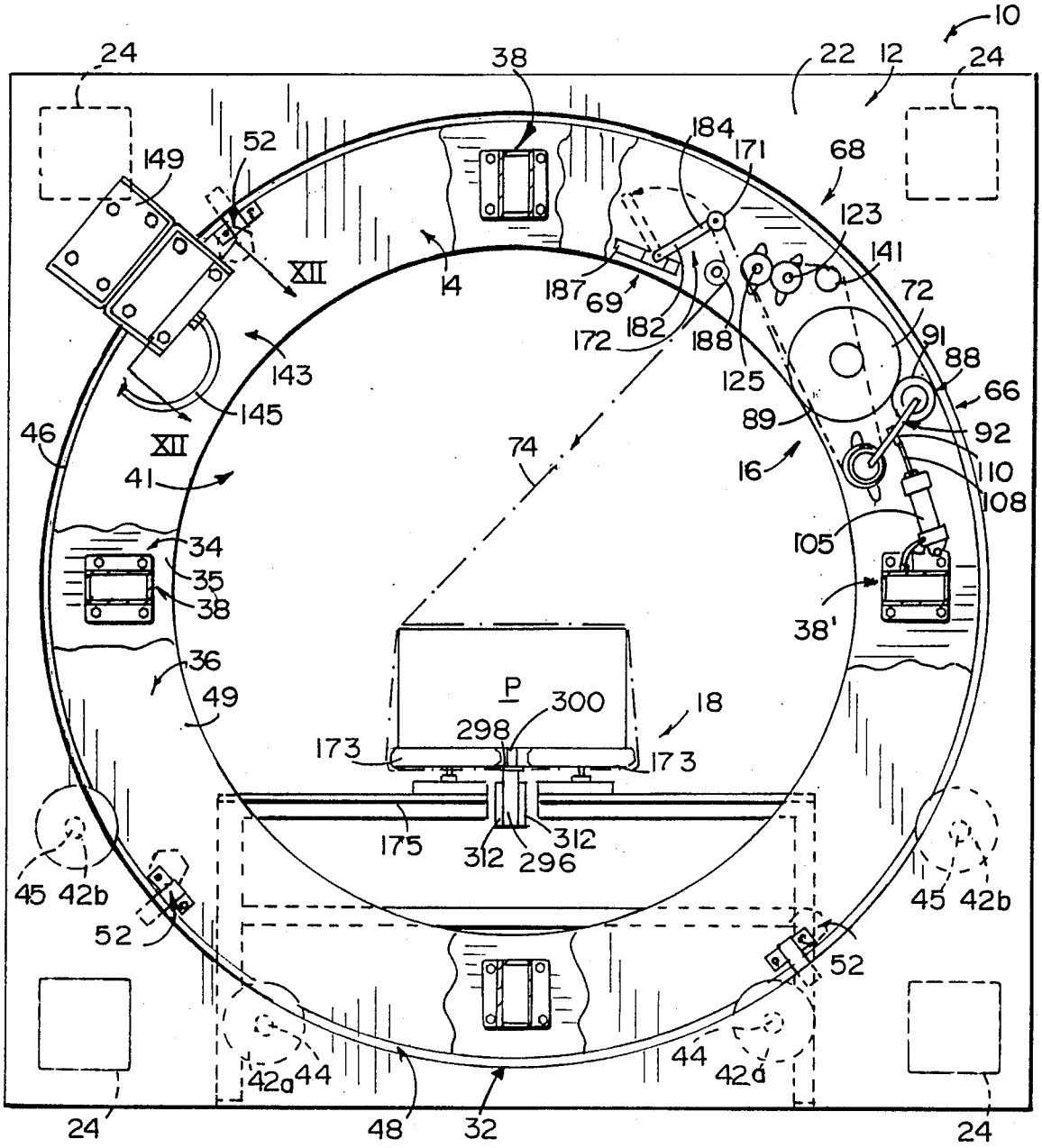
FIG. 1 is a front view of a rotary stretch wrapping apparatus of the present invention.

In the preferred embodiment, a rotary stretch wrapping apparatus 10 in accordance with the present invention includes a fixed base frame 12, a rotary cage or support structure 14, a wrapping assembly 16, and a conveyor system 18. These components cooperate with one another to effect the wrapping of a wide variety of products with a protective plastic film.

Figure 2:
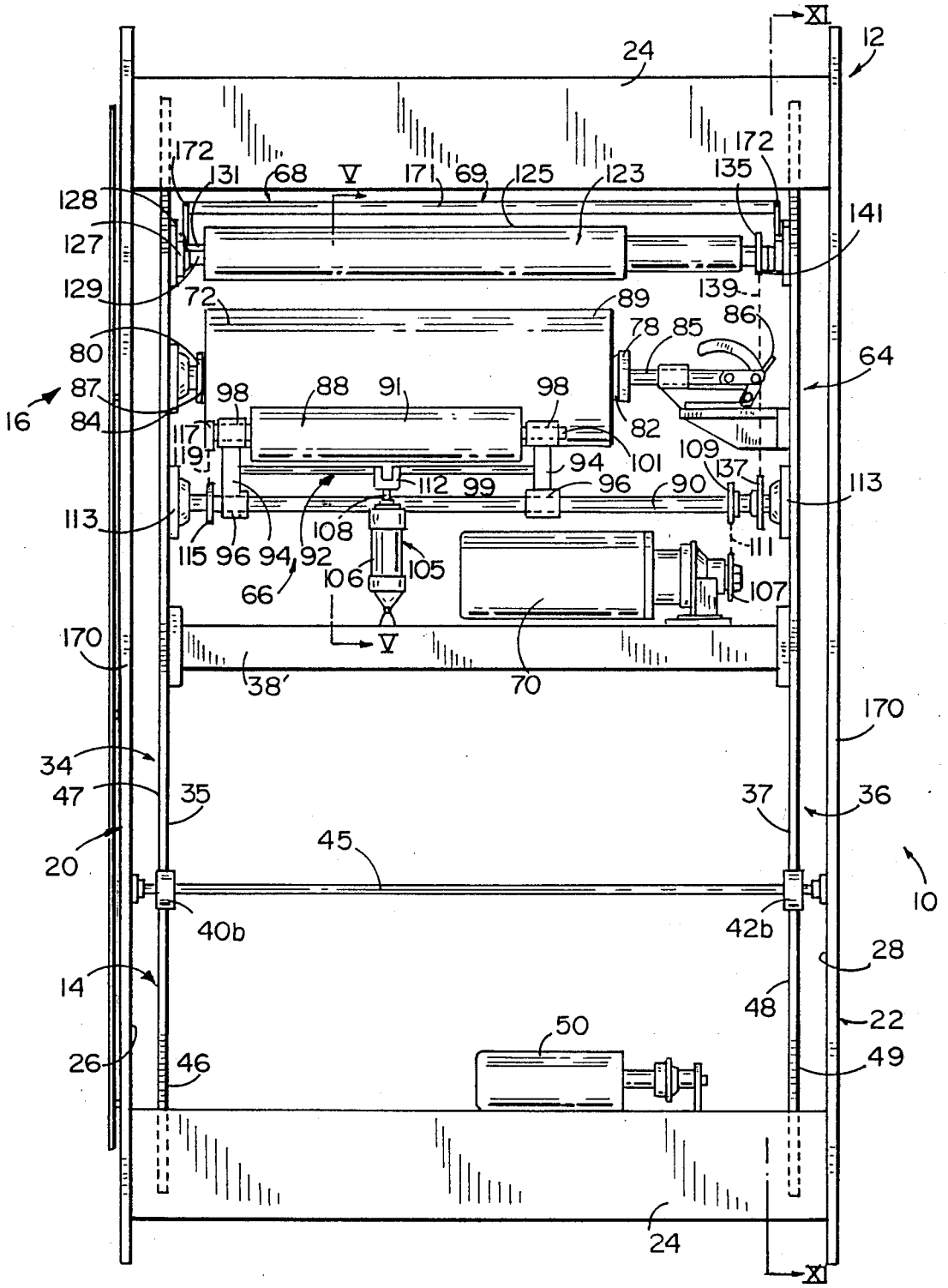
FIG. 2 is a side view of the apparatus.
Figure 3:
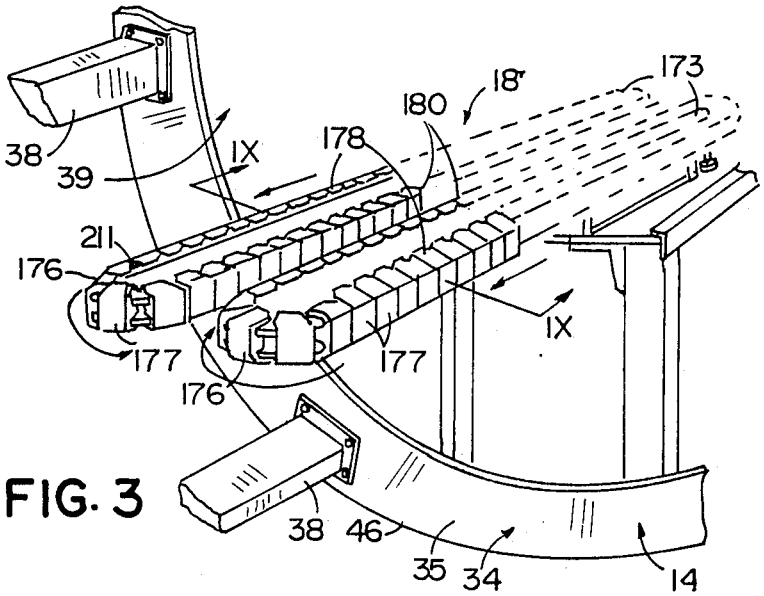
FIG. 3 is a fragmentary perspective view of the apparatus showing a conveyor system of the present invention with the clamping assembly omitted for clarity.
Figure 4:
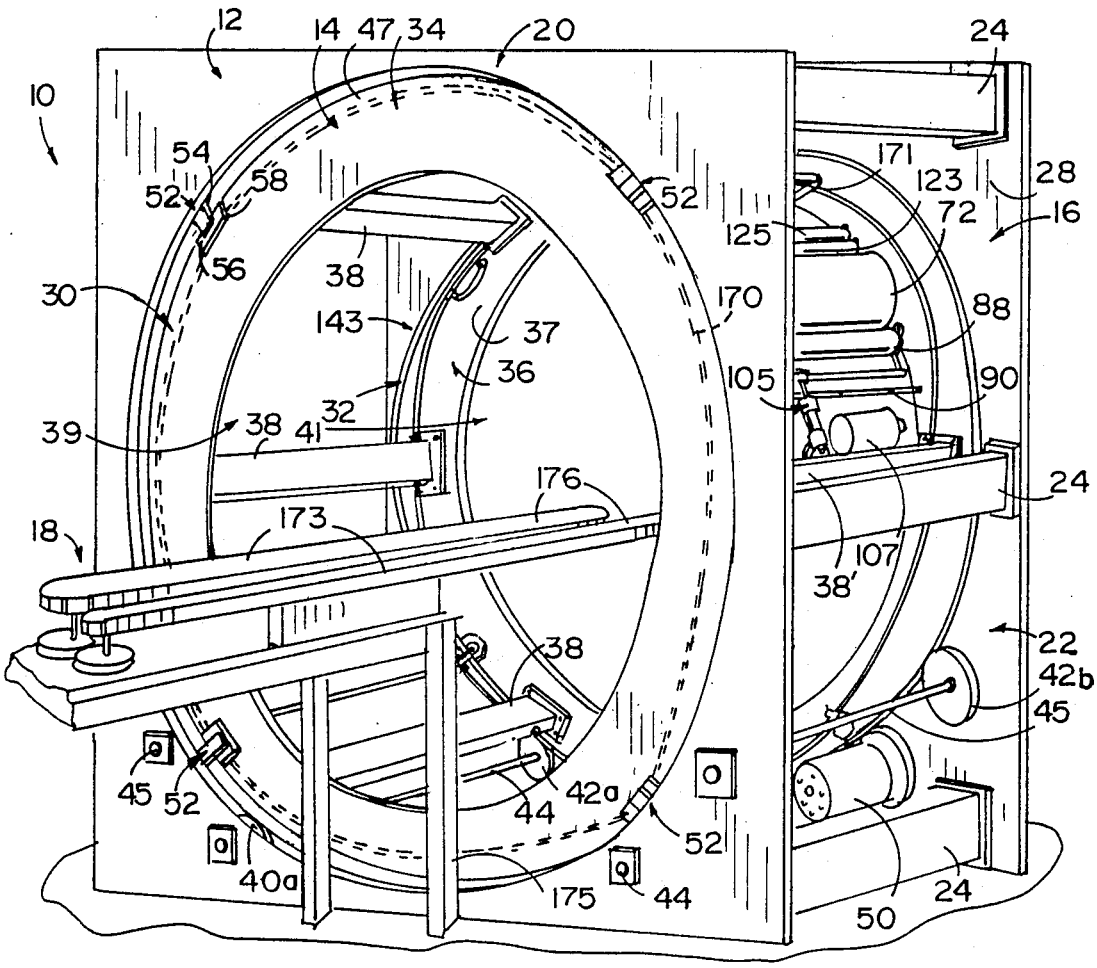
FIG. 4 is a rear fragmentary view of the apparatus with the clamping assembly omitted for clarity.

Base frame 12 includes a pair of upstanding large metal sheets 20, 22 and a plurality of horizontal interconnecting beams 24 (FIGS. 1, 2 and 4). Beams 24 are bolted or otherwise secured to the inner faces 26, 28 of sheets 20, 22 along their periphery, to provide a large stable base with which to effect the wrapping operation. Each sheet 20, 22 defines a large central opening 30, 32 through which the products to be wrapped are passed.

Rotary cage 14 is rotatably mounted to base frame 12 to achieve wrapping of the products as discussed below. Cage 14 is comprised of a framework including a pair of annular rings 34, 36 and a plurality of interconnecting brace members 38 (FIGS.1 –4). Braces 38 are bolted or otherwise fixedly secured to the inner faces 35, 37 of rings 34, 36 to form a uniform and stable rotary support structure. Rings 34, 36 further define a pair of aligned openings 39, 41 positioned concentrically within openings 30, 32 of base frame 12, to permit passage of the products.

Cage 14 is mounted for rotation about a substantially horizontal axis by a plurality of rollers 40, 42 journaled between sheets 20, 22 (FIGS. 1–2, 4, and 11). Preferably, eight support rollers are provided along the lower portions of base frame 12 to support cage 14. In particular, the rollers 40, 42 are paired upon rotatable shafts 44, 45 such that four rollers 40 engage the outer peripheral edge 46 of forward ring 34 and four rollers 42 engage the peripheral edge 48 of rearward ring 36. In the most preferred embodiment, the four lower-most rollers **40*a*, 42*a* are driven by an electric motor 50 and a conventional chain drive (not shown) to rotate cage 14. As a safety measure, motor 50 is preferably a fail-safe break motor which will stop the rotation of cage 14 if the power is cut off. The four upper-most rollers 40*b*, 42*b* are idler rollers provided for support of the cage. Of course additional support rollers could be provided about the entire periphery of rings 34, 36 if needed or desired. Generally, the size and weight of cage 14** precludes it from lifting upwardly when rotated.

To further support and position cage 14, each sheet 20, 22 includes a plurality of lateral stops 52 positioned around openings 30, 32 (FIGS. 1 and 4). Stops 52 slidingly engage the outer surfaces 47, 49 of rings 34, 36 to prevent the cage from moving longitudinally. Each stop 52 includes a mounting tab 54 fixed to base frame 12 and a shoe 56 having a low-friction end surface 58 pressed against the cage rings 34, 36.

Wrapping assembly 16 includes a number of components secured to cage 14 for rotation therewith about the products (FIGS. 1–2, 4, and 5). Additionally, a cooperating counterweight (not shown) is also preferably secured to cage 14 to offset the weight of wrapping assembly 16 and thereby achieve greater balance. In short, wrapping assembly 16 functions to mount the rolls of plastic wrapping film, dispense the film as the cage is rotated, and effect prestretching of the film before it is wrapped about the product. Wrapping assembly 16 includes a film mounting structure 64, a roll driving assembly 66, a film prestretching arrangement 68, dancer roll assembly 69, and an electric motor 70.

Film mounting structure 64 is adapted to releasably mount a roll of the plastic film 72 for rotation about a substantially horizontal axis (FIG. 2). The film 74 is preferably a conventional plastic wrapping film (e.g. polyethene), such as one commercially available from Mobil Oil Corporation or Presto Corp. Of course, other suitable materials could be used. As is conventional, the film 74 is rolled upon a core 76 for easy storage, handling, and use. Film mounting structure 64 includes a pair of rotatable hubs 78, 80 each having a head which is received within the hollow core 76, and a shoulder abutment 82, 87 which flushly engages against the ends thereof. To effect installation and release of the rolls one hub 78 is longitudinally movable toward and away from core 76. More specifically, hub 80 is journaled for rotation to ring 34 by a support 84 which maintains the hub in a fixed longitudinal position. The other hub 78 is journaled for rotation by a longitudinally movable support 85 secured to ring 36 by a toggle or other type of clamp 86. Alternatively, both hubs 78, 80 could be mounted for longitudinal movement.

Figure 5:
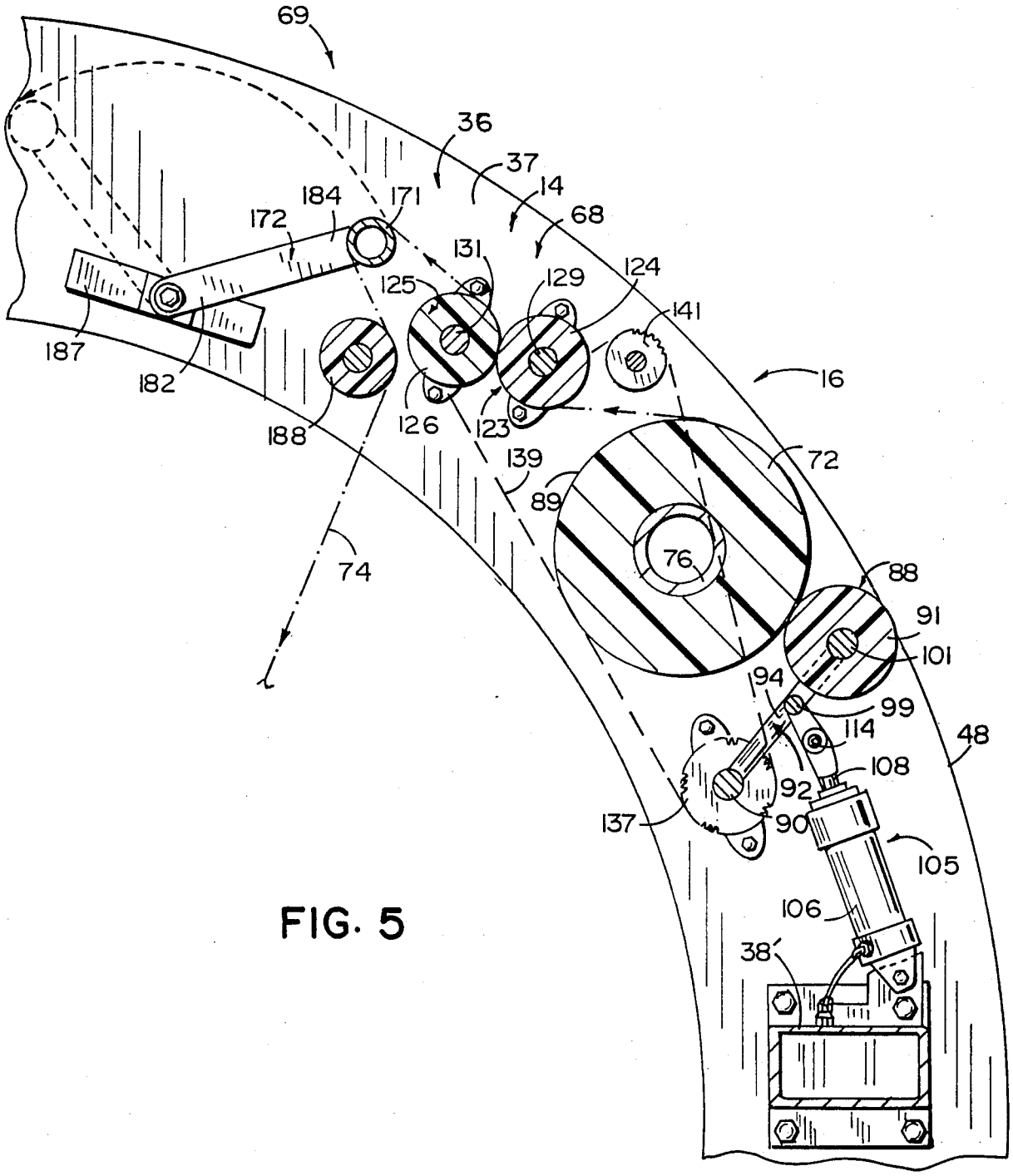
FIG. 5 is a cross-sectional view taken along line V—V in FIG. 2 with the electric motor omitted for clarity.
Figure 6:
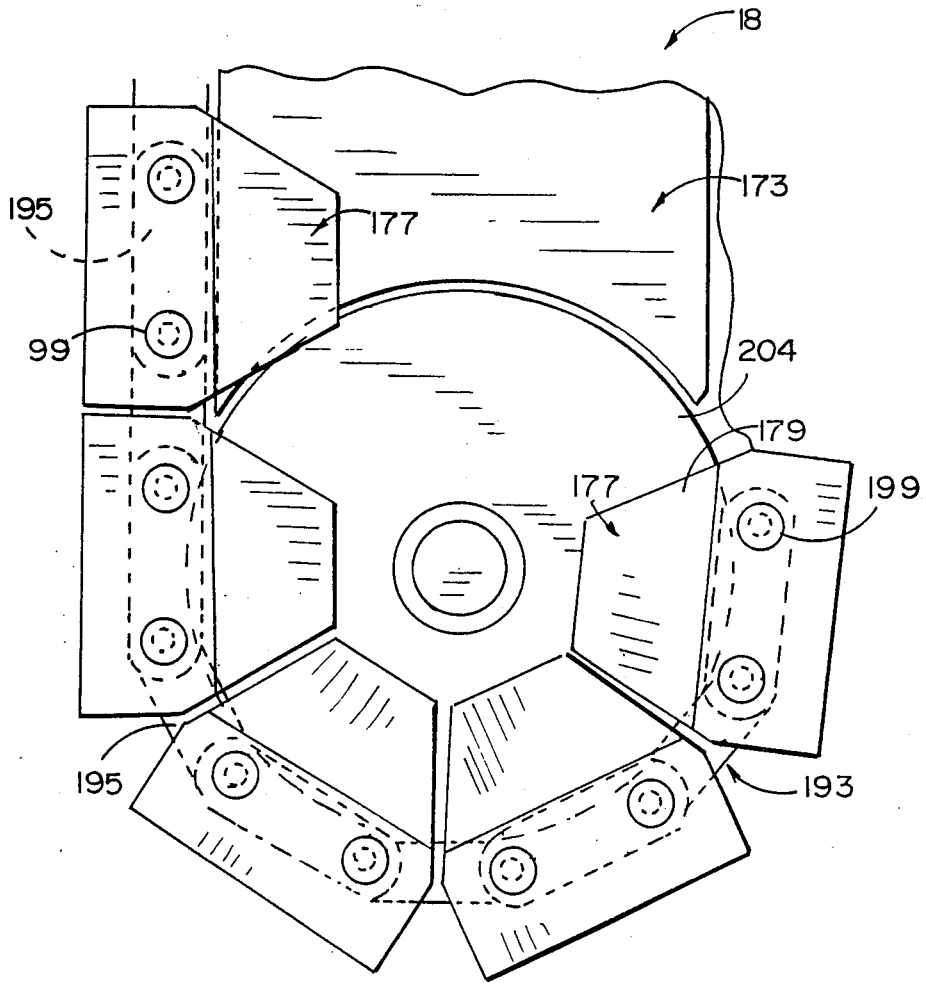
FIG. 6 is a top fragmentary view of a portion of one end of one of the conveyors.
Figure 7:
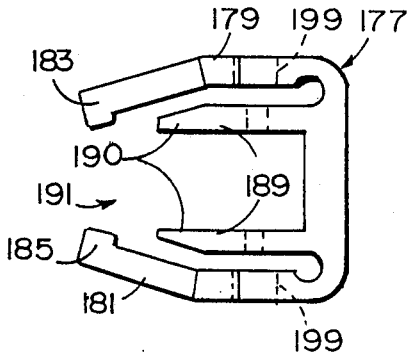
FIG. 7 is a side elevational view of a resilient lug of the conveyor system.
Figure 8:
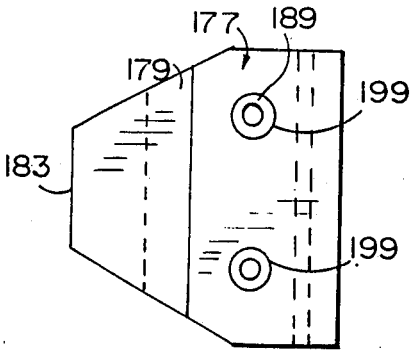
FIG. 8 is a top plan view of the lug.

Film 74 is dispensed from roll 72 by a roll driving assembly 66 (FIGS. 1–2 and 5). Roll driving assembly 66 includes a driving roller 88 adapted to engage the outer periphery 89 of the roll of film 72 at all times during the wrapping operation. Driving roller 88 preferably includes a resilient outer pad 91 (preferably composed of urethane) fixedly secured upon a central, driven mounting pin 101. As can be readily appreciated, this arrangement will dispense film 74 at a substantially constant rate irrespective the diameter of the roll 72.

Driving roller 88 is pivotally mounted for arcuate movement about a drive shaft 90 secured between rings 34, 36. More specifically, an H-shaped connector 92 includes a pair of mounting segments 94 having bearings 96, 98 at each end thereof, and an interconnecting rod 99. Bearings 96 function to mount segments 94 on drive shaft 90 so that connector 92 is neither affected by nor inhibits the shaft's rotation. Bearings 98 rotatably secure segments 94 to the central mounting pin 101 of driving roller 88. Rod 99 is fixedly attached to and interconnects segments 94 to facilitate the coupling of a biasing cylinder 105 to roller 88.

Biasing cylinder 105 provides a constant force which presses driving roller 88 against the outer surface 89 of roll 72, so that no significant slippage occurs therebetween to disrupt the wrapping operation. Biasing cylinder 105 is a pneumatic cylinder having a casing 106, piston (not shown) movably positioned therein, and an extended piston rod 108. The distal end 110 of piston rod 108 is pivotally secured to connecting rod 99 by a bifurcated bracket 112 and cooperating bolt 114. Casing 106 is likewise pivotally secured to an adjacent brace 38' so that cylinder 105 can move to accommodate the variable extension of rod 108 as the film 74 is dispensed.

Biasing cylinder 105 is supplied with a substantially constant pressure of air so that roller 88 engages roll 72 with sufficient pressure throughout the entire dispensation of film 74. The air pressure for cylinder 105 is maintained through a unique supply system 143 (FIGS. 4 and 10–12). Supply system 143 includes a central unit (not shown) which is of a conventional design and includes a pump, filter, lubricator, and regulator for supplying, controlling, and maintaining a constant air pressure source through supply hose 145. Supply hose 145 is fluidly coupled to an air shoe 147 adapted to transfer the pressurized air to cage 14.

Figure 12:
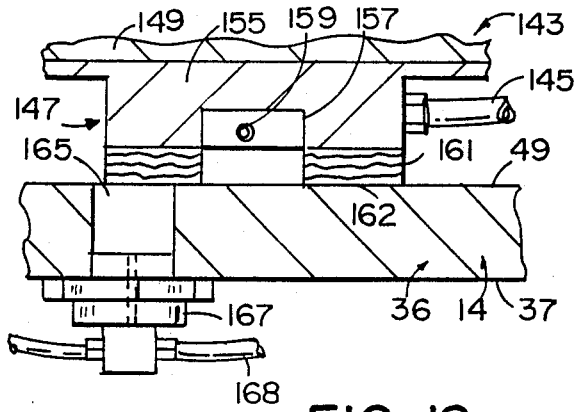
FIG. 12 is a cross-sectional view taken along line XII—XII in FIG. 1.

Air shoe 147 includes a body 155 secured to the underside of a support structure 149 via bolting or the like, and a sealing ring 161 secured to body 151 via an adhesive or other securing means to form an integral air shoe unit (FIG. 12). Air shoe 147 defines a radial bore 159 and a cavity 157 extending at right angles thereto. Cavity 157 opens at one end through an end face 162 of ring 161, and is fluidly coupled at its opposite end to bore 159. Bore 159, in turn, is coupled to supply hose 145 so that the supply of pressurized air is passed through air shoe 147. Air shoe 147 is positioned such that end face 162 is firmly pressed against the outer face 49 of ring 36 to form an air-tight seal therewith. Preferably, sealing ring 161 is composed of conventional V-packing material, although other materials having a low-frictional characteristic and sealing qualities could be used. The pressurized air passed into cavity 157 is transferred to an air routing system 169 provided on rotating cage 14.

Routing system 169 includes a plurality of spaced apart holes 165 defined in and extending completing through ring 36. A check valve unit 167 is securely mounted along the inner surface 37 of ring 36 at each hole 165. As ring 36 rotates during the wrapping operation, holes 165 will be sequentially passed across cavity 157 of air shoe 147 and thereby given a shot of pressurized air. The air, then, passes through check valve 167 and into conduit 168 supported by ring 36.

Figure 10:
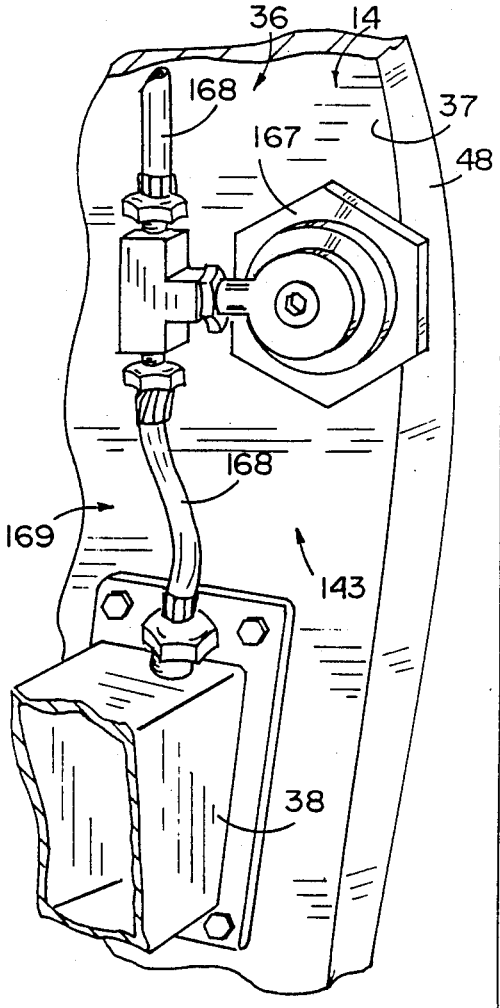
FIG. 10 is a fragmentary perspective view of a portion of the air pressure system of the apparatus.
Figure 11:
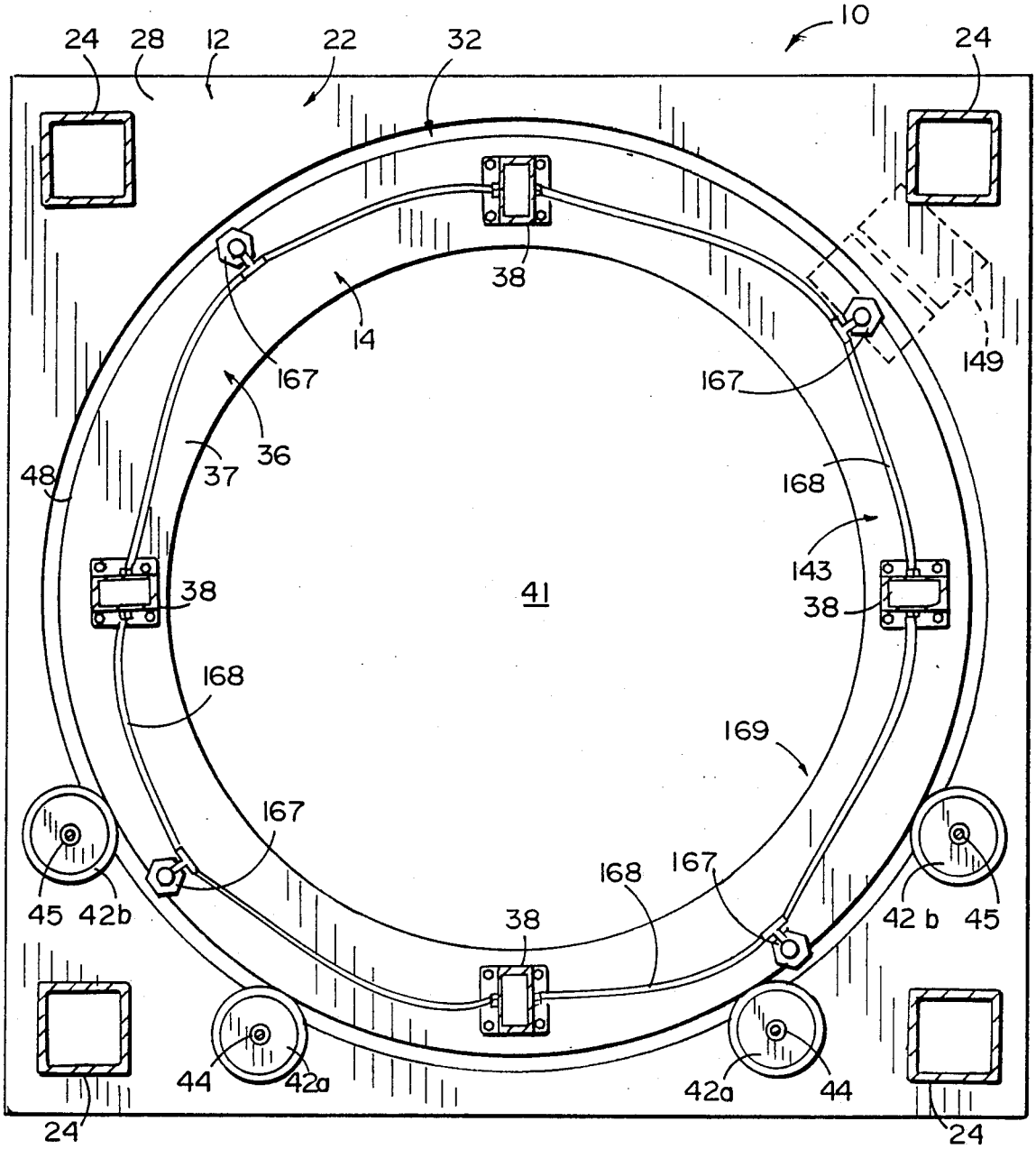
FIG. 11 is a cross-sectional view taken along line XI—XI in FIG. 2 with the wrapping assembly omitted for clarity.

Each of the braces 38 has a hollow air-tight construction (FIGS. 10 and 11). Braces 38 are interconnected with one another, and with check valves 167, by conduit 168 (flexible or otherwise) (FIGS. 4 and 10–12). Hence, the pressurized air is passed through check valves 167 and travels via conduit 168 to braces 38. As seen in FIG. 5, biasing cylinder 105 is then fluidly coupled with the brace 38' to which it is secured. In this way, the fluid pressure remains substantially the same despite the expansion of cylinder 105 and any loss of air due to leaks in the system.

In an alternative embodiment, supply system 143' is a closed system such that the air in braces 38 is pressurized before the operation begins (through a port not shown) and then pressurized again only upon need. This arrangement will be sufficient for most operations.

Driving roller 88 is preferably driven by an electric DC motor 70 through a series of chains and sprockets (FIG. 2). Of course, other driving arrangements could be used. Motor 70 is fixedly attached to one of the braces 38 of cage 14 for rotation therewith. In the preferred embodiment motor 70 is mounted to the same brace 38' as biasing cylinder 105, although such mounting is not necessary. The power for motor 70 is preferably supplied through a conventional arrangement of slip rings 170 secured to the outer surface of sheet 22 about opening 32. Slip rings 170 are well known tracks, such as commonly used to power overhead cranes and the like, positioned in a circular manner circumscribing opening 32. Annular ring 36 of cage 14 includes common mating elements (not shown) to electrically couple to the tracks. Motor 70 includes a motor sprocket 107 which provides the necessary output to dispense and prestretch the film.

Drive shaft 90 is journaled for rotation between rings 34, 36 by mounts 113. Drive shaft 90 functions to transfer the output power of motor 70 to the roll driving and prestretching components. More particularly, power sprocket 109 is keyed to drive shaft 90 opposite motor sprocket 107. The two sprockets 107, 109 are operably coupled by chain 111 to effect a driving rotation of drive shaft 90.

A first driving sprocket 115 is also keyed to drive shaft 90 for concurrent rotation therewith. Opposite sprocket 115, and coupled therewith by chain 119, is a driving roller sprocket 117 keyed to mounting pin 101. Driving roller sprocket 117, then, effects driving rotation of roller 88 upon activation of motor 70. The mounting of driving roller 88 directly on drive shaft 90 also permits the driving roller sprocket 117 to move arcuately about first driving sprocket 115, without disrupting the coupling therebetween.

Once film 74 is dispensed from roll 72 by driving roller 88, it passes through a pair of prestretching pinch rollers 123, 125 (FIGS. 1–2, and 5). Pinch rollers 123, 125 each include a resilient pad 124, 126 (preferably composed of urethane) fixedly mounted on axles 129, 131 which are each journaled between rings 34, 36 by mounts 127, 128. Each axle 129, 131 includes an axle sprocket 133, 135 which is aligned and coupled with a second driving sprocket 137 (keyed to drive shaft 90) by chain 139. This driving arrangement further includes an idler sprocket 141 rotatably attached to inner face 37 of ring 36. Idler sprocket 141 facilitates the proper routing of chain 139 to obtain the necessary opposite rotations of pinch rollers 123, 125. As best seen in FIGS. 1 and 5, chain 139 follows a serpentine path outwardly of idler sprocket 141, inwardly of axle sprocket 133, and outwardly of axle sprocket 135. This arrangement enables pinch rollers 123, 125 to cooperate with one another in moving the film 74 therebetween. Axle sprockets 133, 135 are of equal size so that the pinch rollers rotate at the same rate.

The sizes of the first and second driving sprockets 115, 137, the driving roller sprocket 117, the axle sprockets 133, 134, the pinch rollers 123, 125, and the driving roller 88 are all selected such that the pinch rollers 123, 125 operate to pass the film 74 therethrough at a quicker rate than driving roller 88 dispenses the film 74 from roll 72. In this way, then, film 74 is stretched a predetermined amount prior to being wrapped about the product. Preferably, the film is to be elongated approximately 50 percent, although other amounts could be chosen. Of course, the speeds of the pinch rollers and driving roller are also coordinated with the rotation rate of cage 14.

After the film passes through pinch rollers 123, 125 it is directed through dancer roll assembly 69 (FIGS. 1 and 5). More specifically dancer roll assembly 69 includes a dancer roller 171 pivotally mounted between rings 34, 36 by a pair of pivot arms 172. The dancer roller is preferably a tubular aluminum member so as to be light weight and yet still sufficiently rigid. Of course other types of rollers could be used. Each pivot arm 172 includes a mounted end 182 and a free end 184, wherein the mounted end 182 is pivotally attached for movement about a substantially horizontal axis 186 and the free end rotatably mounts roller 171. In particular, at least one of the pivot arms 172 (and preferably both) is pivotally secured to a rotary actuator 187. The rotary actuator is a conventional device utilizing a pressurized rack and pinion arrangement designed to apply a substantially constant torque on the pivot arms 172, to thereby bias the dancer roller 171 away from pinch rollers 123, 125. Dancer roll assembly 69 further includes a guide roller 188 which is secured between rings 34, 36 to guide the film around the rotary actuator 187.

Dancer roll assembly 69 is used to partially compensate for irregularities in the shape of the product. For example, referring to FIG. 1, it can be readily seen that the lower surface of the product P is closer to the rings 34, 36 than its upper surface. Hence, wrapping assembly 16 will tend to dispense a greater amount of film when it traverses above the product than it will when it traverses below the product. To accommodate this inconsistency, the dancer roller is adapted to take up the slack when too much film is dispensed and permit extra film to be used when too little film is being dispensed. For example, as the wrapping assembly 16 rotates about the top of the product P dancer roller 171 will be biased in a counter-clockwise direction (as shown in FIG. 5) so that it moves gradually away from pinch rollers 123, 125 and takes up the accumulating slack being otherwise generated. Thereafter, as the roll of film and dispensing means rotate around to the lower end of the product P, more film than is being dispensed will be required, and the tension on the film will tend to pull the dancer roller 171 back toward the pinch rollers 123, 125 to use the film accumulated as it traveled across the top of the product P.

The products to be wrapped are passed through cage 14 on a unique conveyor system 18 (FIGS. 1, 3–4, 6 and 9). Conveyor system 18 generally comprises two horizontally adjacent endless conveyors 173. Conveyors 173 are mounted on a support stand 175 in a cantilever manner such that their free ends 176 extend well within and substantially through cage 14. In a rotary stretch wrapping process, the conveyors 173 along with the product are tightly wrapped with a plastic film. To facilitate effective operation of the device, the portions of the conveyors 173 contacted by the plastic film 74 must be moving in the same direction as the product to be wrapped; otherwise the conveyors and the product will be fighting against one another and a proper wrap will not be achieved.

In the present invention the two conveyors 173 are substantially arranged about vertical axes in a horizontal plane such that the forward, carrying path portions 178 of the conveyors are positioned along the outer paths and the rearward, return path portions 180 of the conveyors oppose one another along the interior paths. Each of the conveyors 173 includes a plurality of resilient lugs 177 which are positioned adjacent to one another in end-to-end relationship along the entire conveyor. To obviate the resistance generated by the return path, lugs 177 are expanded along the forward supporting paths so that along the top of the conveyors the product to be wrapped is supported above the return path, and along the bottom of the conveyors the plastic film 74 wrapped around the conveyors is held off the return path. Each lug 177 is formed as a one-piece, resilient plastic member, preferably composed of urethane. Of course other materials having the requisite strength and resiliency could be used. Each of the lugs 177 includes a pair of outer arms 179, 181 which are positioned along the top and bottom of the conveyors 173, respectively (FIGS. 6–9). Each arm 179, 181 is bent along its mid-section such that its natural shape is contracted with the distal ends of the arms 183, 185 directed toward one another at an inclination of approximately 30°. Each arm further narrows toward its distal end 183, 185 to facilitate its travel around the ends of the conveyors.

Positioned between arms 179, 181 are a pair of mounting flanges 189 which define a gap 191 therebetween. A link 195 of an endless chain 193 of one of the conveyors 173 is received within gap 191 between each pair of mounting flanges 189. Chain links 195 of each chain 193 are interconnected by hollow pins 197. Mounting flanges 189 of lugs 177 are secured to pins 197 by riveting, screw threading, or other securing means, so that the lugs travel with the driven chain. To facilitate access to the connections, arms 179, 181 are provided with access holes 199. Mounting flanges 189, along their outer ends 190, also receive a pair of substantially parallel conveyor plates 201, 202. Plates 201, 202 are fixedly secured together for support, and are mounted to support stand 175 to support the cantilevered conveyors 173. This engagement between flanges 189 and plates 201, 202 also helps to stabilize the position of the lugs 177.

A conveyor sprocket 204 is rotatably mounted at each end of the two conveyors 173 for engagement with the chain 193. Drive sprockets **204*a*, positioned above support stand 175, are driven by a conventional electric motor (not shown). Idler sprockets 204*b* are secured to plates 201, 202 at the free ends 176** of the conveyors.

Figure 9:
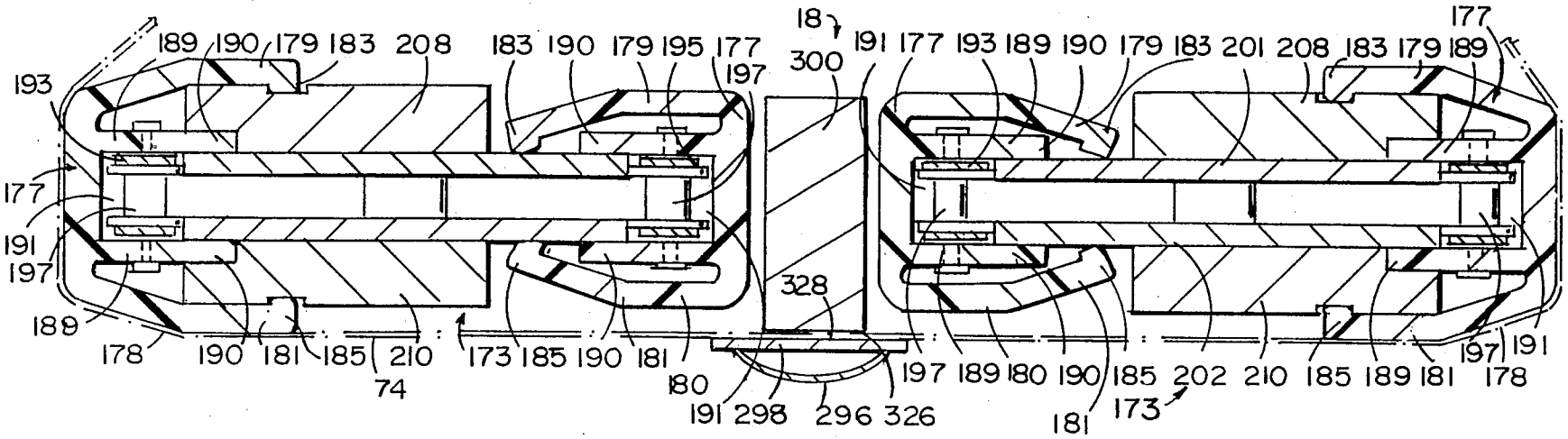
FIG. 9 is a cross-sectional view taken along line IX—IX in FIG. 3.
Figure 17:
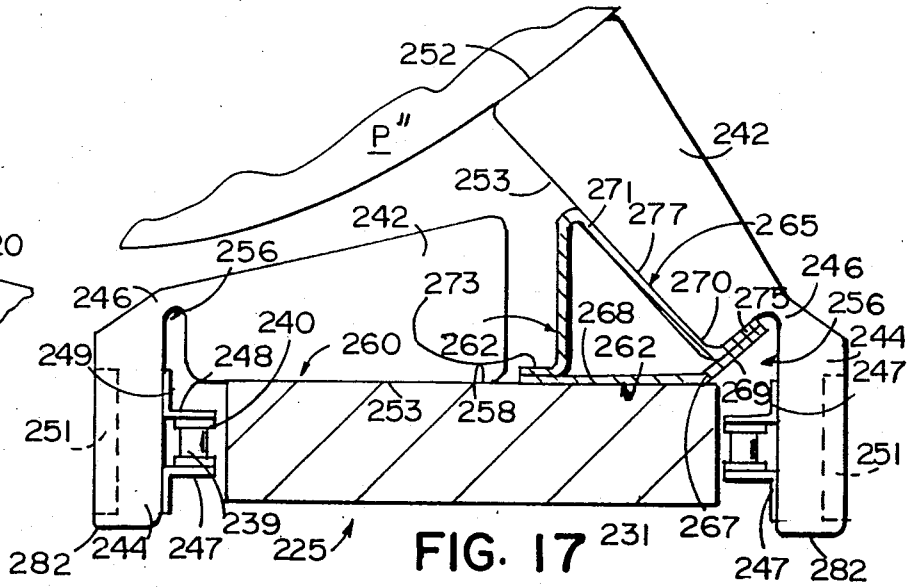
FIG. 17 is an enlarged sectional view of one of the conveyors of the third embodiment.

To facilitate the expansion of lugs 177 as they travel along the forward carrying paths 178, a pair of elongated cams 208, 210 are fixedly attached to the upper and lower conveyor plates 201, 202 of each conveyor 173. These cams 208, 210 push arms 179, 181 outwardly along the forward paths, such that they expand beyond the arms of the lugs 177 traveling along return paths 180 (FIG. 9). These cams 208, 210 extend the entire length of the conveyors and are tapered at each end 211 to provide an easy and gradual expansion and contraction of the lugs 177.

Figure 13:
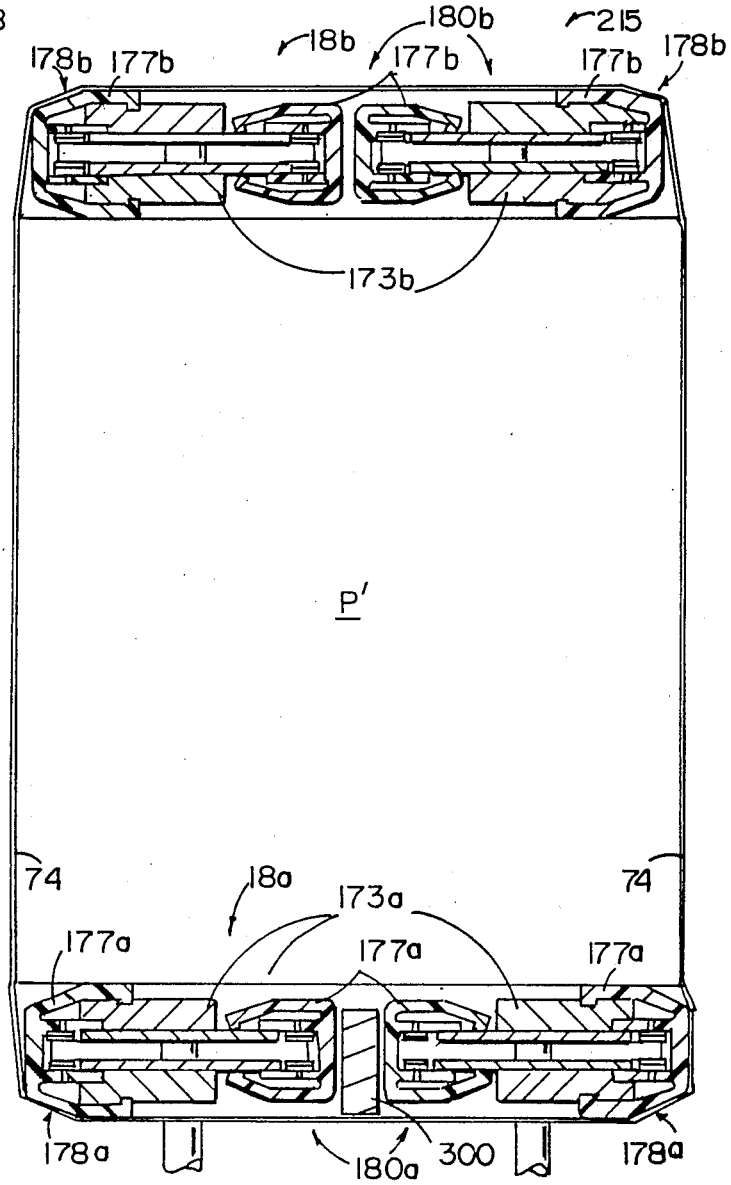
FIG. 13 is a sectional view of a second embodiment of the conveyor system of the apparatus.

In an alternative embodiment 215, a pair of spaced apart vertically aligned conveyor systems **18*a*, 18*b* are provided to lend additional support to a particularly tall or off-balanced product P′ (FIG. 13). In this arrangement, the apparatus operates in the same manner as discussed above, except that the product is fed and sandwiched between a lower conveyor system 18*a* and an upper conveyor system 18*b*. The conveyor systems 18*a*, 18*b*, are identical to the conveyor system 18 described above; with the possible exception that the central clamping jaw may be eliminated from the top conveyor system. The plastic film 74 is wrapped about both conveyor systems 18*a*, 18*b* and engages the lugs 177*a*, 177*b* traveling the four forward path portions 178*a*, 178*b* of the conveyors 173*a*, 173*b***. Further, the products may be sequentially fed and separated down stream by a cutter, or may be individually wrapped as needed.

Figure 16:
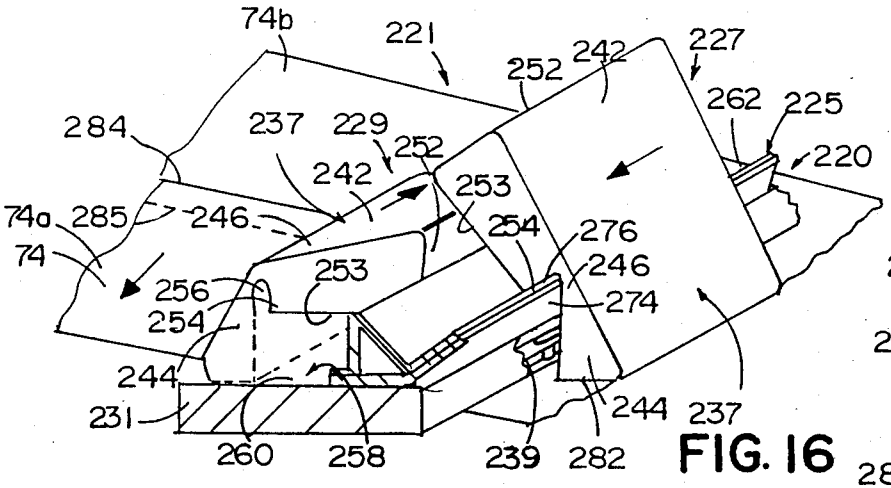
FIG. 16 is a fragmentary perspective view of one of the conveyors of the third embodiment.
Figure 14:
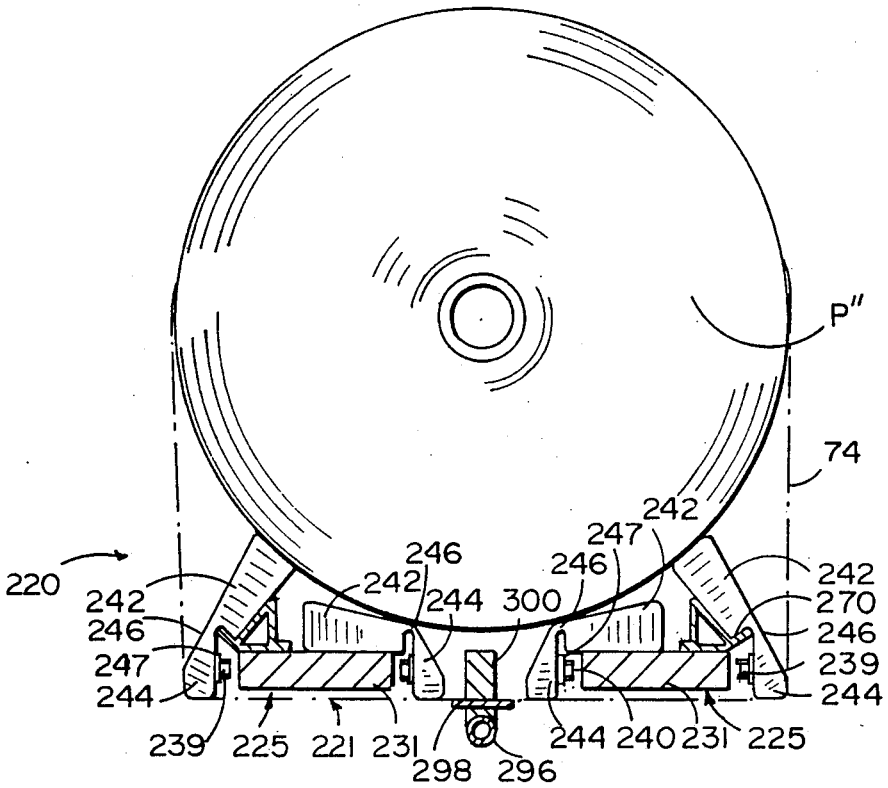
FIG. 14 is a sectional view of a third embodiment of the conveyor system of the apparatus.
Figure 15:
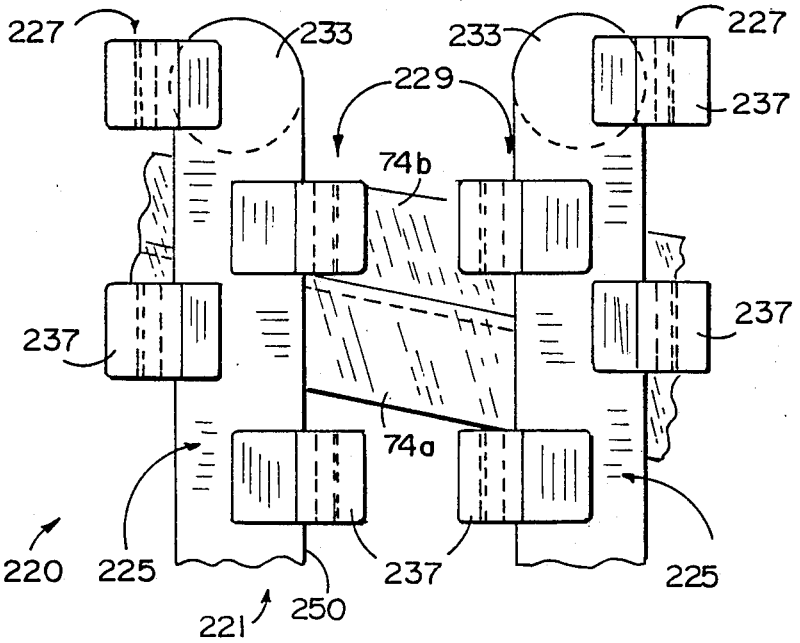
FIG. 15 is a top fragmentary view thereof.
Figure 18:
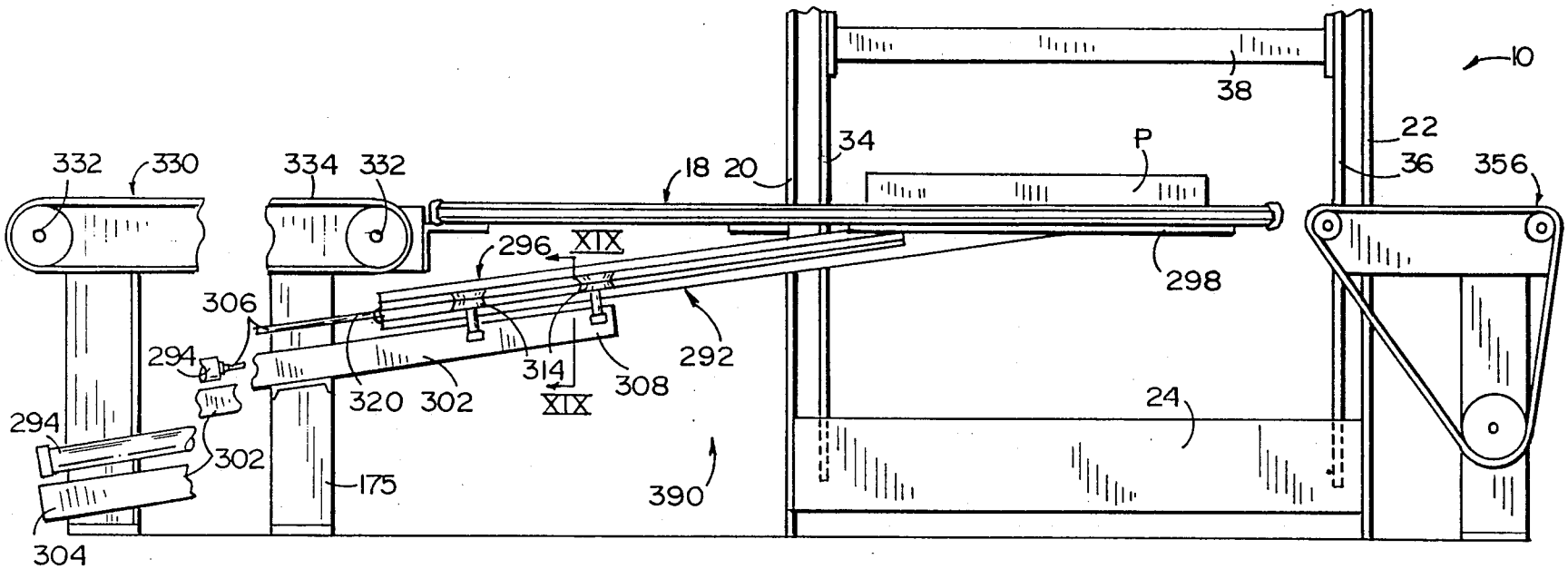
FIG. 18 is a side elevational view of the clamping assembly, with the wrapping and driving assemblies omitted for clarity.
Figure 20:
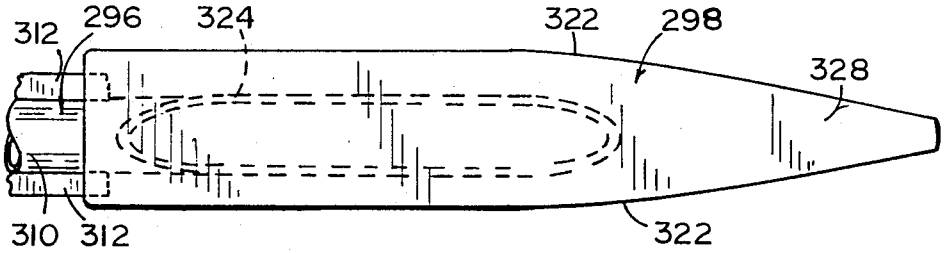
FIG. 20 is a top plan view of the movable jaw of the clamping assembly.
Figure 19:
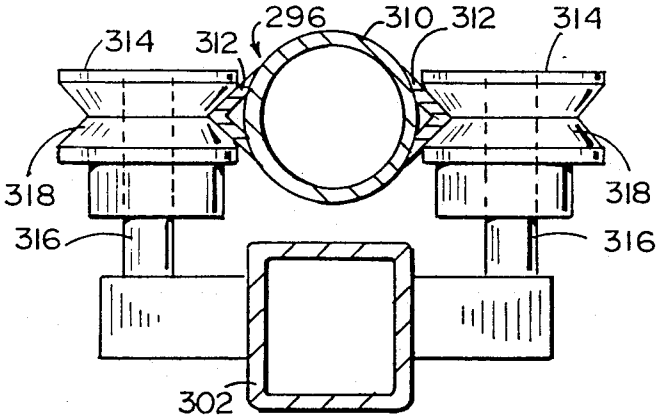
FIG. 19 is a cross-sectional view taken along line XIX—XIX in FIG. 18.
Figure 23:
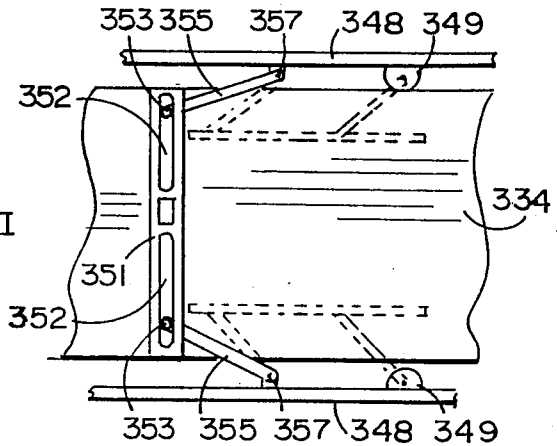
FIG. 23 is a cross-sectional view taken along line XXIII—XXIII in FIG. 22.
Figure 26:
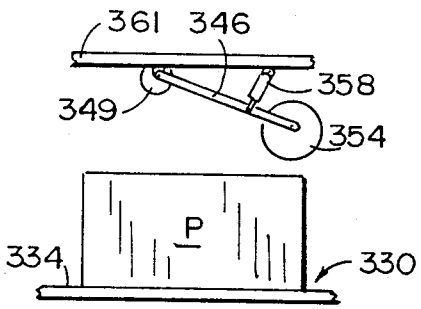
FIG. 26 is a side elevational view of an alternate embodiment for measuring the height of the product.
Figure 22:
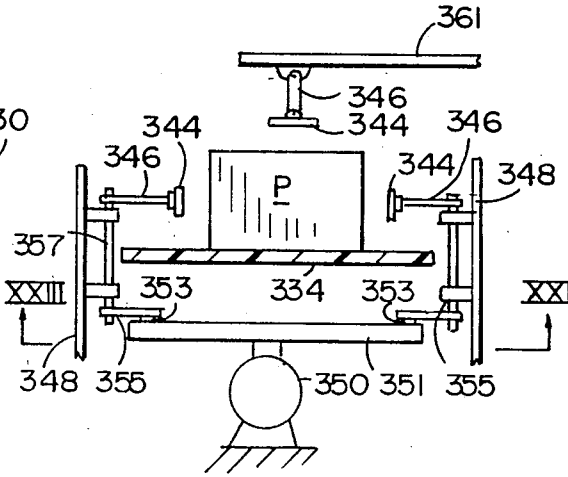
FIG. 22 is a cross-sectional view taken along line XXII—XXII in FIG. 21.
Figure 25:
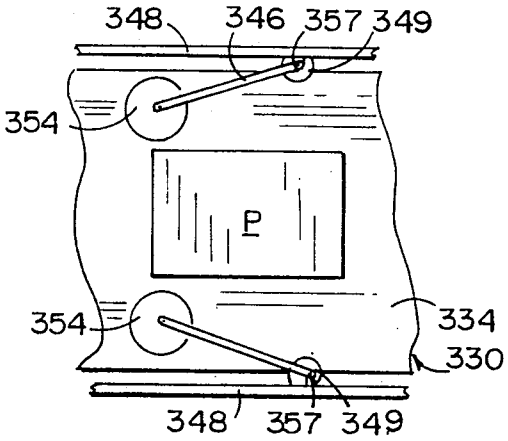
FIG. 25 is a top plan view of an alternate embodiment for measuring the width of the product.
Figure 21:
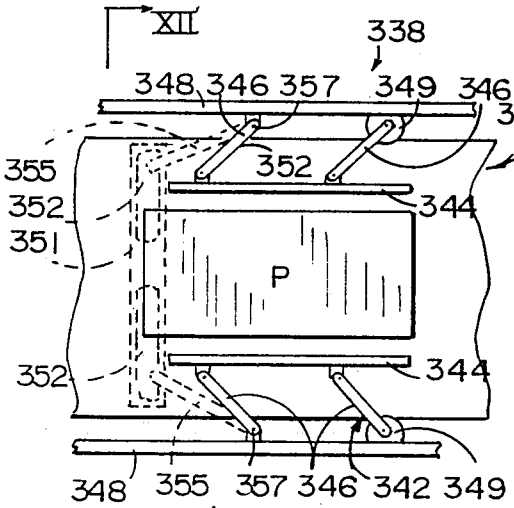
FIG. 21 is a top plan view of the assembly for measuring the width of the product.
Figure 24:
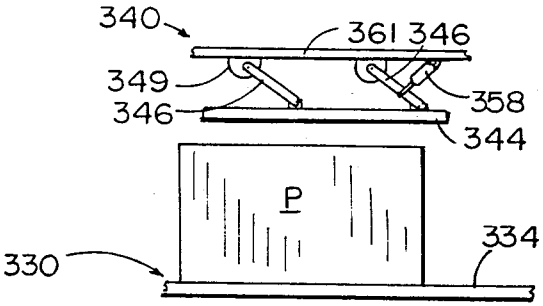
FIG. 24 is a side elevational view of the assembly for measuring the height of the product.

In a third embodiment 220, an alternative conveyor system 221 is provided to support cylindrical products P″ for passage through cage 14 (FIGS. 14–16). Conveyor system 221 is similar to conveyor system 18 in that it includes a pair of horizontal adjacent conveyors 225, each having forward conveying paths 227 along the outer sides thereof and return paths 229 along the interior sides thereof.

More specifically, each conveyor 225 includes a elongated base 231, a pair of sprockets 233 positioned at each end of base 231, a plurality of spaced apart resilient lugs 237, and an endless chain 239. Similar to conveyors 173, chain 239 is driven by sprockets **233*a* coupled to a motor at a support stand 175. Lugs 237, in turn, are attached to links of the chain 239 for movement therewith along the forward and return paths 227, 229**.

Each lug 237 is preferably of a unitary construction and includes a supporting portion 242, a mounting portion 244, and a resilient hinge portion 246. Mounting portion 244 is preferably a block-shaped section positioned adjacent endless chain 239 for attachment thereto. L-shaped brackets 247 are used to secure lugs 237 to chain links 240. In particular, a horizontal leg 248 of bracket 247 is fixedly attached to links 240 by screws or the like similar to the attachment of lugs 177, and a vertical leg 249 of bracket 247 is attached to portion 244 by screws or the like. Preferably, the mounting portion 244 of each lug further includes a metal backing plate 251 for additional support. Mounting portion 244 also includes an outer corner 245 which is adapted to engage and tautly hold the plastic film 74 in place. Supporting portion 242 is also preferably a block-like member having a distal, engaging surface 252, a lower guiding surface 253, and an opposite bracing surface 254 for adequately supporting product P″ as discussed below. Supporting portion 242 and mounting portion 244 are coupled together by a relatively thin hinge portion 246 along the upper surfaces thereof to facilitate the requisite pivotal movement of supporting portion 242. Hinge portion 246 defines a recess 256 between supporting portion 242 and mounting portion 244.

Each base 231 includes a top surface 258 having a return portion 260 along the interior side thereof and a cam bracket 262 attached along the exterior side. Cam bracket 262 is preferably comprised of a pair of metal frames 263, 265 fixed by welding or the like into a integral structure. Bottom frame 263 is preferably an elongated metal plate extending entirely across the length of the conveyors and having longitudinal bend 267 along a medial section thereof. Bend 267 defines a mounting segment 268 adapted to be secured to top surface 258 by bolting or the like and a supporting segment 269 projecting upwardly and outwardly therefrom so as to define an angle of approximately 120° with mounting segment 268. Of course this angle could be varied. Upper frame 265 has a substantially inverted V-shaped segment 271 having first and second outer flanges 273, 275. The outer flanges 273, 275 lie flushly against mounting segment 268 and supporting segment 269, respectively, for mounting thereto (preferably by welding).

Bracket 262, then, functions to expand lug 237 and move supporting portion 242 upward to support the cylindrical product P″ thereon. Second outer flange 275 and bearing face 277 of segment 271 cooperatively define a channel 270 adapted to receive and lift the supporting portion 242 of lug 237. Flange 275 and bearing face 277 then slidingly engage against bracing surface 254 and guiding surface 253 to receive and support the weight imposed on the lug by the product P″. Also, as with cams 308, 210, brackets 262 are tapered downwardly to the top surface 258, to accommodate a gradual expansion and contraction of the lugs 237.

The return portion 260 is defined by the top surface 258 along which the lower guiding surface 253 of supporting portion 242 is slidingly engaged when traversing the inner return portions of conveyors 225. Lugs 237 are shaped and oriented such that supporting portions 242 naturally, without additional biasing means, assume the shape in the return mode.

In the third embodiment 220, the bottom faces 282 of mounting portions 244 are adapted to lie along the inner sides of the film 74. Nevertheless, film 74 is so tautly wrapped about the outer lugs that the inner lugs merely slide along without impairing the wrapping operation. Moreover, the overlap of the film strips further eliminates any possible impairment. More specifically, the trailing edge 284 of the prior strip of film **74*a* overlaps the forward edge 285 of the trailing strip of film 74*b*** along the inside surfaces over which the return lugs pass, so that easy sliding therebetween is achieved.

In order to provide sufficient support for the cylindrical products P" and lift the products adequately so as to avoid contact with the return path lugs, support portions 242 are of increased length in comparison to the arms 179, 181 of lugs 177 in conveyor system 18. To accommodate this increased length, lugs 237 are spaced apart so that they are able to traverse the turns around sprockets 233 without interfering with one another.

To begin the wrapping operation, the leading end of the film must be held in place until one or two subsequent wraps overlap it to hold it in place. In the preferred embodiment, the leading end of the film is clamped into place by a clamping assembly 290. Clamping assembly 290 includes a reciprocal clamping element 292 which has a fluid cylinder 294, a guiding rod 296, and a movable jaw 298. The movable jaw 298 is adapted to cooperate with a fixed elongate jaw 300 mounted between the two horizontal conveyors 173 or 225 irrespective of the particular embodiment of conveyor system. In short, the movable jaw 298 is reciprocally movable so that it is adapted to clamp or release the film between itself and the fixed jaw 300.

More specifically, the reciprocal clamping element 292 includes a supporting beam 302 mounted beneath support stand 175. Supporting beam 302 is mounted at an inclination to the horizontal at an angle of approximately 20°. This angle of course could be varied a great deal. Fluid cylinder 294 is fixedly secured to the lower end 304 of beam 302 with piston rod 306 positioned for reciprocal movement toward and away from the upper end 308 of beam 302.

Guiding rod 296 is attached to the free end of piston rod 306 and is positioned directly above beam 302 in a substantially parallel relationship therewith. Guiding rod 296 is preferably comprised of a tubular core 310 having a pair of elongated ears 312 attached along opposite sides thereof. Ears 312 are preferably angle members which have been welded in place. Attached to beam 302 and projecting upwardly along each side of guiding rod 296 are a plurality of guiding rollers 314. Rollers 314 are mounted for rotation about substantially vertical axles 316 (they are actually inclined to the vertical approximately 20°) and have a V-shaped outer periphery 318 adapted to engage and mate with ears 312. Hence, as piston rod 306 is reciprocated back and forth, guide rod 296 with ears 312 are guidingly moved in a longitudinal direction by guiding rollers 314.

Movable jaw 298 is fixedly attached to distal end 320 of guiding rod 296. Movable jaw 298 essentially comprises a planar plate member having a pair of tapering outer sides 322. The tapering of sides 322 permit the jaw 298 to be withdrawn more easily after the wrap has been begun, as discussed below. To mount movable jaw 298 in place, tubular core 310 is preferably cut to form a horizontal edge 324 to which jaw 298 is firmly secured by welding or the like.

Fixed jaw 300 is essentially an elongated block member adapted to fit between horizontal conveyors 173 (or 225). The lower face 326 of jaw 300 is adapted to be positioned just slightly above the point at which the film is stretched across the lower portions of the conveyors. The lower movable jaw 298 then is able to securely clamp the film between its upper face 328 and the lower face of fixed jaw 300.

In use, when beginning a new roll of film, the film is manually fed beneath the conveyors with the movable jaw in its lower release position (not shown) wherein the jaw as retracted beneath support stand 175. Once the film is so positioned, the fluid cylinder 294 is actuated so that the guiding rod 296 and movable jaw 298 are moved upwardly along supporting beam 302, until upper face 328 of jaw 298 engages and presses the film against lower face 326 of jaw 300. Cage 14 is then rotated once or twice about the product P (already positioned above movable jaw 298) to overlap the leading end of the film clamped by the jaws 298, 300. These first two rotations, are performed without actuating the conveyor system 18 so that the leading end of the film will be securely held by the overlying strips when movable jaw releases it, and so that the jaws 298, 300 do not interfere with the forward movement of the film with the lugs. Once the leading end has been overlapped with the subsequent strips, fluid cylinder 294 is actuated in the reverse direction so that guiding rod 296 and movable jaw 298 move downwardly along the supporting beam 302 to release the film from its grip. Thereafter, the operation can continue so the product is spirally wrapped with the film. At the end of the wrapping of the product, the fluid cylinder 294 is once again actuated so that movable jaw 298 engages the trailing end of the film between itself and fixed jaw 300. The film may then be severed and the wrapped product removed for shipment. Conventional sensors (not shown) coupled to a central processing unit (not shown) may be used to automate the above discussed process.

Product P is advanced toward conveyors 173 on a feed conveyor 330. Feed conveyor 330 is preferably of a typical endless conveyor design having a pair of horizontal axles 332 designed to rotate a supporting belt loop 334. As the product is advanced along feed conveyor 330, it is preferable to measure the width and height of the product so that its irregularities may be accounted for in the wrapping operation. As discussed above, the dancer roll assembly 69 is provided to accommodate certain irregularities. However, the dancer roll assembly 69 is capable of accommodating irregularities only up to a certain level. If the products have substantial irregularities (e.g. a wide, flat product or a tall, thin product), the dancer roll assembly 69 will not have sufficient leeway to make up the needed difference. Therefore, a preliminary measuring assembly 336 is provided along feed conveyor 330.

Preliminary measuring system 336 includes a width measuring component 338 and a height measuring component 340. Once these measurements have been taken, the results are transmitted to the central processing unit (not shown) which then determines the desired rate for dispensing the film for that particular product. More particularly, the rotation rate of cage 14 is always held at a constant rate. The adjustment then, is made at motor 70 which controls the speed of dispensing roller 88 and pinch rollers 123, 125. The adjustment is preferably made by adjusting the voltage supplied to the DC motor 70 so that it runs at a faster or slower rate as needed. Depending on the product, the adjustment may be made so that an average speed is chosen which will accommodate complete wrapping of the product. Alternatively the adjustment may be made during the wrapping operation so that the dispensing rate increases and decreases as needed during the rotation of the cage about the product P.

The width measuring component includes a pair of opposing lateral assemblies 342 each of which includes an elongated engaging plate 344 connected to a pair of pivot bars 346 for lateral, reciprocal movement toward and away from the product P. More specifically, each pivot bar 346 is pivotally mounted to an upstanding support 348 at one end and to plate 344 at its opposite end. Moreover, the pivot bars 346 on each side, are arranged in a substantially parallel relationship, so that engaging plate 344 is kept in a substantially parallel relationship with the longitudinal axis of feed conveyor 330.

To effect movement of the assemblies 342, a band fluid cylinder 350 is provided beneath the belt 334. The cylinder 350 is fixedly mounted along the longitudinal axis of the belt 334. The piston (not shown) of cylinder 350 is attached to a transverse coupling bar 351 for imparting longitudinal movement thereto. Coupling bar 351 includes a pair of transverse slots 352 which are adapted to pivotally receive a pin 353 fixed to a coupling arm 355. The opposite ends of the arms 355 are fixedly secured to pivot bars 346 by a vertical rod 357. Vertical rod 357 is approximately a foot long and facilitates the spacing necessary to position pivot bars 346 above belt 33 and coupling arms 355 below belt 334.

In operation, a product P is stopped momentarily on feed conveyor 330 between lateral assemblies 342. Fluid cylinders 350 are then actuated such that coupling bar 350 is moved longitudinally such that coupling arms 355 and pivot bars 346 are arcuately swung outward from upstanding supports 348, until engaging plates 344 engage the opposite sides of the product P. This movement will be typically controlled by a pair of coordinating sensors on each engaging plate or by pressure sensors coupled with the fluid cylinders. Furthermore, conventional measuring devices 399 will be coupled to at least one of the pivot bars 346 to determine the width dimension of the product P. Also, as with the clamping assembly, conventional sensors (not shown) coupled to the central processing unit (not shown) may be used to automate the system.

Moreover, lateral assemblies 342 also act to center the product on feed conveyor 330 which, in turn is aligned with conveyors 173. Hence, assemblies 342 effect substantial centering of the products on conveyors 173. This arrangement then helps reduce irregularities in the wrapping procedure.

The height measuring device is designed to be similar to the lateral assemblies in that it utilizes pivot bars 346, engaging plate 348 and a fluid cylinder 358. Engaging plate 344 is mounted to an upper assembly 361, fixedly mounted over feed conveyor 330, for vertical movement so as to press the product between itself and the conveyor belt 334. As can be readily appreciated, the actuation of the cylinder 358 will move engagement plate 348 toward or away from the top of the product.

In an alternate embodiment, either or both of the horizontal and height measuring components, may be mounted with engagement rollers 354 which are each mounted to a single pivot bar 346 pivotally mounted to an upstanding support 348. As in the previous embodiment, a fluid cylinder 350 or 358 is used to arcuately move pivot bars 346 so that the engagement roller 354 is moved toward and away from the product P. This embodiment can be used to avoid stoppage of the product along the feed conveyor, which may be desirable if a continuous series of products are being wrapped. Further, the vertical height adjustment may alternatively also be a series of vertical photo-eyes (not shown) which would optically measure the height of the product in a known manner. Conventional sensors (not shown) coupled to the central processing unit may also be used for automatic operation of the machine.

In the operation of the apparatus 10, a product P (or P′ or P″ if different embodiments are utilized) is first placed upon a feed conveyor 330 for advancement toward conveyors 173. When the product is positioned between the lateral assemblies 342, it is stopped temporarily, (or not, depending on the embodiment) so that the height and width may be measured, and so that the product may be centered. These measurements are transmitted to the central processing unit which determines the needed film dispensing rate and makes any necessary changes in the voltage to be supplied to motor 70. Subsequently, the product is advanced and fed on to conveyors 173.

The product rests upon conveyors 173 such that it is supported upon the expanded lugs 177 moving along the forward paths 178. The product P, if it is the first product to be wrapped, is advanced until its front edge is substantially aligned with the forward edge of the film 74. At this point, the film 74 may be placed in the clamping assembly 290. Cage 14 is then rotated once or twice to provide a plurality of overlapping strips which will tightly hold the leading end in place. Thereafter, the movable jaw 298 is retracted to release the film and the conveyors 173 are again actuated such that the product will be completely wrapped in a spiral wrap of the film. Due to the tension on the film, the overlying strips will clamp down and hold the leading end in place after the movable jaw 298 is released.

Subsequently, a series of products may follow in a continual manner without stopping conveyors 173 or cage 14. These products are then separated by a conventional cutting apparatus downstream from apparatus 10. The film 74 is wrapped relatively tightly about the product P and conveyors 173 such that it will tend to contract toward the product when the product is fed off free ends 176 of conveyors 173. The gap provided between conveyors 173 and downstream conveyor 356 will permit this contraction to take place so that the film is easily fed on-to the downstream conveyor. As time progresses, the film will tend to contract further against the product to provide an even tighter wrap. Of course, the apparatus can also be used to individually wrap products by using the clamping assembly 290 after each product has been wrapped.

The above description is that of a preferred embodiment of the invention. Various alterations and changes can be made without department from the spirit and broader aspects of the invention as set forth in the appended claims, which are to be interpreted in accordance with the principles of patent law, including the doctrine of equivalents.

What is claimed is:

1. A wrapping apparatus comprising:

a base;

a rotary support structure rotatably mounted on said base and including means for dispensing film for wrapping a product as said support structure is rotated; and a conveyor system including two endless conveyors positioned horizontally adjacent to one another and passing through said rotary support structure, each conveyor having a path loop including a forward moving path portion for carrying an article and a rearward moving path portion, said forward and rearward path portions being oriented in a substantially horizontal plane, each said conveyor further including a plurality of expandable lugs and means for moving said lugs of each conveyor about said path loop therefor, each of said conveyors further including means for expanding said lugs on said forward moving path portion in a direction perpendicular to the direction of movement to raise the article above the rearward moving path portion and for contracting said lugs as they traverse said rearward moving path portions.

2. A wrapping apparatus as defined in claim 1 in which said conveyors are positioned adjacent to one another such that said rearward path portions are positioned between said forward path portions.

3. A wrapping apparatus as defined in claim 1 in which each said conveyor further includes cam means positioned along said forward path portions for expanding said lugs as they traverse said forward path portions.

4. A wrapping apparatus as defined in claim 1 in which each said lug comprises a one-piece resilient member provided with a pair of expandable arms.

5. A wrapping apparatus as defined in claim 1 in which said lugs traveling along said forward path portions are expanded into an orientation for securely supporting a cylindrical product.

6. A wrapping apparatus as defined in claim 5 in which each said lug includes a distal face, wherein said distal faces are adapted to engage said cylindrical product when traversing said forward path portions and be directed to face toward the lugs traversing one of the forward path portions when traversing said rearward path portions.

7. A wrapping apparatus as defined in claim 1 in which each said lug includes a distal face, wherein said distal faces are adapted to engage a product to be wrapped when traversing said forward path portions and be directed to face toward the lugs traversing one of the forward path portions when traversing the rearward path portions.

8. A wrapping apparatus including conveyor means for conveying an object to be wrapped along a path and a wrapper-dispensing means for placing a wrapper about the object and the conveyor means as the object travels along the path, wherein the improvement comprises said conveyor means comprising:

a pair of endless conveyors each including an object-conveying path segment and a return path segment arranged in a generally horizontal plane;

said return path segments of said conveyors being located between said object-conveying path segments; and said conveyors in both said object-conveying path segments extending above and at least as low as said conveyors in said return path segments, whereby an object supported on said conveyors in said object-conveying segments is supported above said conveyors in said return path segments, and further whereby the wrapper passing under said conveyor means is prevented from engaging said conveyor in said return path segments.

9. A wrapping apparatus as defined in claim 8 in which said object-conveying path segments are expanded into an orientation for securely supporting a cylindrical product.

10. A conveyor system comprising two endless conveyors positioned horizontally adjacent to one another, each conveyor having a path loop including a forward moving path portion for carrying an article and a rearward moving path portion, said forward and rearward path portions being oriented in a substantially horizontal plane, each said conveyor further including a plurality of expandable lugs arranged about the entire conveyor and means for moving said lugs of each conveyor about said path loop therefor, each of said conveyors further including means for expanding said lugs on said forward moving path portion in a direction perpendicular to the direction of movement to raise the article above the rearward moving path portion and for contracting said lugs as they traverse said rearward moving path portions.

11. A conveyor system as defined in claim 10 in which said conveyors are positioned adjacent to one another such that said rearward path portions are positioned between said forward path portions.

12. A conveyor system as defined in claim 11 in which each said conveyor further includes a cam means positioned along said forward path portion for expanding said lugs as they traverse said forward path portions.

13. A conveyor system as defined in claim 12 in which each said lug comprises a pair of expandable arms which cooperate with said cam means.

14. A conveyor system as defined in claim 13 in which said moving means for each said conveyor includes an endless driven chain and means for attaching said lugs to said chain for movement therewith.

15. A conveyor system as defined in claim 14 in which each said lug is a one-piece, unitary resilient member.

16. A conveyor system as defined in claim 10 in which each said conveyor further includes cam means positioned along said forward path portions for expanding said lugs as they traverse said forward path portions.

17. A conveyor system as defined in claim 16 in which said lugs traversing said forward path portions are expanded into an orientation for securely supporting a cylindrical product.

18. A conveyor system as defined in claim 17 in which said cam portions include a load bearing face which slidingly engages a corresponding surface on said supported lug to support and receive the bulk of the load placed thereon by the cylindrical product.

19. A conveyor system as defined in claim 17 in which each said lug includes a supporting portion, having a longitudinal axis, which is expanded such that said longitudinal axis is substantially radially positioned relative to the cylindrical product.

20. A conveyor system as defined in claim 19 in which said cam portions include a load bearing face which slidingly engages a corresponding surface on said supported lug to support and receive the bulk of the load placed thereon by the cylindrical product; wherein said load bearing face is oriented substantially perpendicular to said radially positioned axis.

21. A conveyor system as defined in claim 10 in which said each lug includes a one-piece, unitary resilient member provided with a pair of expandable arms.

22. A conveyor system as defined in claim 10 in which said moving means for each said conveyor includes an endless driven chain and means for attaching said lugs to said chain for movement therewith.

23. A conveyor system as defined in claim 22 wherein each said lug includes a pair of mounting flanges which are received about a portion of said chain and attached thereto by said attaching means.

24. A conveyor system as defined in claim 10 in which said lugs traversing along said forward path portions are expanded into an orientation for securely supporting a cylindrical product.

25. A conveyor system as defined in claim 24 in which each said lug includes a distal face, wherein said distal faces are adapted to engage the cylindrical product when traversing said forward path portions and are directed to face toward said lugs traversing one of said forward path portions when traversing said rearward path portions.

26. A conveyor system as defined in claim 24 in which each said lug includes a supporting portion, having a longitudinal axis, which is expanded such that said longitudinal axis is substantially radially positioned relative to the cylindrical product.

27. A conveyor system as defined in claim 24 in which each said lug includes a supporting portion for supporting the cylindrical products as they traverse said forward path portions, said supporting portions being sized to overlap as they pass each other on said forward and rearward path portions.

28. A conveyor system as defined in claim 10 in which each said lug includes a distal face, wherein said distal faces are adapted to engage the cylindrical product when traversing said forward path portions and be directed to face toward said lugs traversing said forward path portions when traversing said rearward path portions.

* * * * *